United States Patent [19]

Gupta et al.

[11] Patent Number: 4,870,406

[45] Date of Patent: Sep. 26, 1989

[54] HIGH RESOLUTION GRAPHICS DISPLAY ADAPTER

[75] Inventors: Satish Gupta, Peekskill, N.Y.; Leon Lumelsky, Stamford, Conn.; Robert L. Mansfield; Hector G. Romero, Jr., both of Austin, Tex.; Marc Segre, Rhinebeck, N.Y.; Alexander K. Spencer, Austin, Tex.; Joe C. St. Clair, Round Rock; James D. Wagoner, Georgetown, both of Tex.

[73] Assignee: International Business Machines Corporation, Armonk, N.Y.

[21] Appl. No.: 13,842

[22] Filed: Feb. 12, 1987

[51] Int. Cl.[4] ..... G09G 1/28

[52] U.S. Cl. ..... 340/70; 340/701; 340/744

[58] Field of Search ..... 340/701, 703, 744, 747

[56] References Cited

U.S. PATENT DOCUMENTS 4,639,879 1/1987 Chaya ..... 340/703
4,648,049 3/1987 Dines et al. ..... 340/703
4,668,947 5/1987 Clarke, Jr. et al. ..... 340/703
4,673,930 6/1987 Bujalski et al. ..... 340/703
4,752,893 6/1988 Guttag et al. ..... 340/747

*Primary Examiner*—David K. Moore
*Assistant Examiner*—Jeffery A. Brier
*Attorney, Agent, or Firm*—George E. Clark

[57] ABSTRACT

A display adapter for displaying graphics data in pixel form on a high resolution display monitor includes a digital signal processor for managing adapter resources and controlling coordinate transformations, a system storage which is divided into a first portion for storing instructions for the digital signal processor and the second portion for storing data representing information to be displayed, an input buffer for permitting asynchronous and overlapped communication between the graphics display adapter and a host computer to speed operation of the system, a pixel processor for drawing vectors and manipulating areas to be displayed on the monitor, a bit mapped frame buffer, a color palette connected to outputs of the frame buffer for providing appropriate color signals to the high resolution monitor and a cursor circuit for controlling display of a cursor on the screen on the monitor.

6 Claims, 1 Drawing Sheet

HIGH RESOLUTION GRAPHICS DISPLAY ADAPTER

BACKGROUND OF THE INVENTION

Cross Reference to Related Copending Applications

U.S. patent application No. 07,013,848 of L. Lumelski filed 2/12/87, entitled "Vector Generator with Direction Independent Drawing Speed for An All Point Addressable Raster Display", discloses a novel vector line drawing system for use with raster scan type video displays and which has both improved speed and versatility of function.

U.S. patent application No. 07/013,841 of R. L. Mansfield et al. filed 2/12/87, entitled "A Graphics Display System Function Circuit" discloses a vector generator similar to that set forth in the above referenced (051) docket which is uniquely suited to the overall video display adapter architecture set forth in the instant application.

U.S. patent application No. 07/013,847 of L. Lumelski filed 2/12/87, entitled "Pixel Data Path for High Performance Raster Displays With All Point Addressable Frame Buffers", discloses a channel architecture which could be utilized in the pixel data path feeding the frame buffer of such an adapter and which enables a number of versatile pixel data operations within the frame buffer. The hardware of this application would be located within the pixel processor block of current application.

U.S. patent application No. 07/013,840 of R. L. Mansfield et al. filed 2/12/87, entitled "A Graphics Display System With Memory Array Access", discloses additional hardware for performing a number of functions in the pixel processor block of the current application. The application relates to hardware for controlling pixel data in the frame buffer of such video adapters providing controllable write masks for use in storing pixel data in an associated frame buffer.

U.S. patent application No. 07/013,849, of R. L. Mansfield et al., filed 2/12/87, entitled A Graphics Function Controller For A High Performance Video Display System", discloses hardware for performing line drawing operations in the pixel processor block of the current application.

U.S. patent application No. 07/013,843 of S. Gupta et al., filed 2/12/87, entitled "A Frame Buffer Capable of Accessing Aligned Square Words of the Screen", discloses a frame buffer architecture which permits a substantial increase in the speed of a number of display operations as well as enhancing the versatility of the adapter in terms of the functions that may be performed off line. The hardware of this application would be located in the "frame buffer" of the preferred embodiment of the present invention.

FIELD OF THE INVENTION

The present invention relates to information display systems and more particularly to means for adapting information from a host computer to be efficiently displayed on a high resolution graphics display monitor.

PRIOR ART

There are currently in the prior art a large number of graphics display adapters for taking graphics input data from a host and providing as an output high resolution pixel data to a graphics display monitor.

For example, the IBM 5085 Graphics Processor converts data transferred from a host as a series of graphics orders into pixel data for display on a high resolution graphics display monitor. The IBM 5085 Graphics Processor is described in the IBM 5080 Graphics System Principles of Operations, IBM Publication GA23-2012-0. The IBM 5085 Graphics Processor employs an attachment processor to control communications between an attached host and the graphics processor and peripheral devices which may be attached to the graphics processor such as plotters, keyboards, graphics tablets, evaluators, etc.

The IBM 5085 Graphics Processor does not include a digital signal processor, or a first-in, first-out instruction buffer nor a gate array pixel processor as does the graphics display adapter according to the present invention.

Further, in the text, *Fundamentals of Interactive Graphics* by Foley and Van Dam, published by Addison Wesley Company, 1982, with a second edition 1984, at chapters three and ten, graphics processing units generally known in the art are described.

However, none of the architectures described for display adapters in the text suggest the graphics display adapter architecture as set forth in accordance with the present invention.

SUMMARY OF INVENTION

Therefore, it is an object of the present invention to efficiently adapt data presented from a host computer to be displayed on a high resolution graphics display monitor by a graphics display adapter which includes a digital signal processor for managing adapter resources and controlling coordinate transformations, a system storage which is divided into a first portion for storing instructions for the digital signal processor and a second portion for storing data representing information to be displayed, a first-in first-out input buffer for allowing asynchronous and overlapped communication between the graphics display adapter and the host computer to speed operation of the system, a pixel processor for drawing vectors and manipulating areas to be displayed on the monitor, a bit mapped frame buffer, a color palette connected to outputs of the bit mapped frame buffer for providing appropriate color signals to the high resolution graphics display monitor, and a hardware cursor circuit for controlling display of a cursor on the screen of the display monitor.

Accordingly, a graphics display adapter for displaying graphics data in pixel form on a high resolution graphics display monitor includes: a digital signal processor for managing adapter resources and controlling coordinate transformations, a system storage which is divided into a first portion for storing instructions for the digital signal processor and a second portion for storing data representing information to be displayed, a first-in first-out input buffer for allowing asynchronous and overlapped communication between the graphics display adapter and the host computer to speed operation of the system, a pixel processor for drawing vectors and manipulating areas to be displayed on the monitor, a bit mapped frame buffer, a color palette connected to outputs of the bit mapped frame buffer for providing appropriate color signals to the high resolution graphics display monitor, and a hardware cursor circuit for controlling display of a cursor on the screen of the display monitor.

The foregoing and other objects, features, and advantages of the invention will be apparent from the more particular description of a preferred embodiment of the invention as illustrated in the accompanying drawing.

DETAILED DESCRIPTION OF A PREFERRED EMBODIMENT

As the speed and capacity of graphics workstations and personal computers including graphics adapter increases, the demand for high resolution intelligent display adapters also increases. Large graphic applications, formerly limited to large main frame computers with dedicated graphics display terminals may use this increased capability in the workstations to migrate applications to stand alone systems. The present invention relates to a graphics display adapter which can be used either in such a high capacity stand alone graphics workstation or in conjunction with a large main frame host computer.

Figure 1:
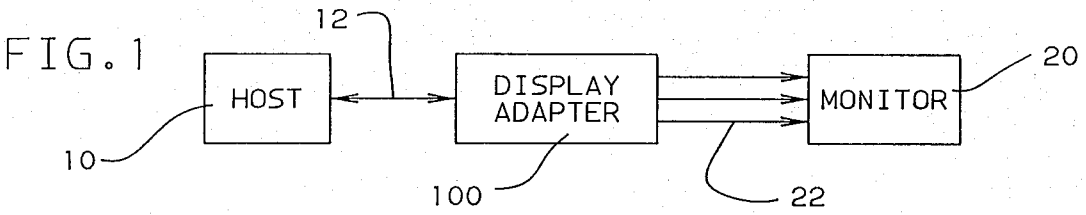
FIG. 1 is a simplified block diagram illustrating a system in which a graphics display adapter according to the present invention would be employed.

Referring now to FIG. 1, the environment in which the present invention may be best employed will be described.

A host computer 10 which has been discussed above may be either a large remote main frame computer or it may be a processor mounted within the same mechanical environment as is the graphics display adapter according to the present invention. It may be operatively connected to the graphics display adapter 100 by a communication bus 12. Graphics instructions and data are transmitted from the host to the display adapter on bus 12. Display adapter 100, which will be described in further detail below, processes the instructions and data received from host computer 10 and provides pixel data for display on a high resolution graphics monitor 20. The outputs of display adapter 100 are communicated to monitor 20 by signal lines 22 which carry video signal information to monitor 20.

Typically, display adapter 100 will support a resolution of 1K by 1K pixels and 256 simultaneous colors from a palette of 4K possible colors.

Figure 2:
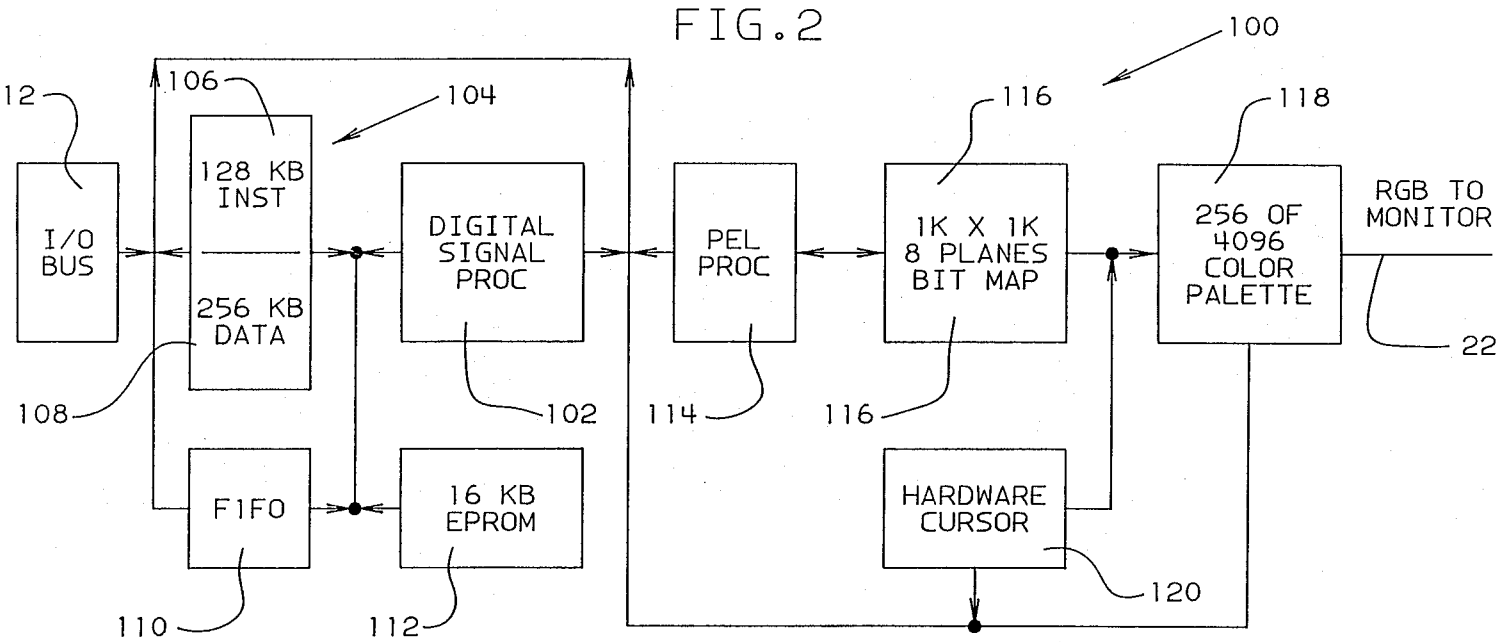
FIG. 2 is a block diagram of a graphics display adapter according to a preferred embodiment of the present invention.

Referring now to FIG. 2 the structure of graphics display adapter 100 will be described in greater detail. A digital signal processor 102 manages the resources of display adapter 100 and performs coordinate transformation as required. The digital signal processor 102 may be implemented with a commercially available digital signal processor integrated circuit TMS 32020. Graphics instructions and data are transmitted on host input/output bus 12 and stored in system storage 104 which includes an instruction store 106 and a data store 108. Each portion 106 and 108 of storage 104 has sufficient data storage or instruction storage capacity for efficient operation of the display adapter. To increase the efficiency and speed of operation of the system and to avoid waste time due to host-adapter communication, a first-in, first-out buffer 110 is employed and connected to the bus 12 and to digital signal processor 102 as well as to system storage 104 for temporarily storing graphics instructions and data received from the host computer 10. FIFO 110 may particularly be implemented by a commercially available integrated circuit, IDT 7202, and include 1K 16 bit words for storing information received from the I/O bus 12, on a first-in, first-out basis to permit overlap operation across the host-display adapter interface. A programmable read only memory 112 can provide the initial program load for the system. Particularly, programmable read only memory 112 may include 16K bytes of 16 bit words. It is, of course, possible to expand the size of PROM 112 if a greater initial program load storage is required.

Pel processor 114 includes a set of custom gate arrays which assist the digital signal processor 102 in updating bit map memory 116. Pel processor 114 performs vector generation functions and bit block manipulation (BITBLT) functions in bit mapped frame buffer 116. Pel processor 114 is described in greater detail in co-pending U.S. patent application Ser. No. 07/013,840.

The output of pel processor 114 is connected to the bit mapped frame buffer 116 which has the capacity to store 8 bits of information for each of 1K by 1K pixels which are then mapped to corresponding pixel positions on the graphics display monitor (not shown). Thus, over one million pixels each having up to 256 different characteristics may be stored in the bit mapped frame buffer 116. Bit mapped frame buffer is described in greater, detail in co-pending U.S. patent application Ser. No. 07/013,843.

One or more planes of the bit mapped frame buffer 116 may be used for special functions. For example, one plane of the eight planes available in bit map 116 may be designated as an overlay plane and used in conjunction with color palette 118 to provide highlighting or blinking at a programmable rate. With blinking enabled, any pixel having a bit in this plane will blink at the programmable blink rate. With highlighting enabled, a bit in the overlay plane overrides the normal color palette processor and substitutes therefore a color from a three entry overlay color palette. It should be noted that the use of one of the eight planes of the bit map for overlay reduces the number of available colors by a factor of 2. Thus, only half as many colors may be chosen if the overlay plane is being used for highlighting or blinking.

Color palette 118 provides a choice of 256 colors from a total palette of 4,096 colors. The color palette acts on the output from the bit map frame buffer 116 and provides color signals on lines 22 to a display monitor (not shown). The color palette 118 may be implemented by a commercially available integrated circuit BT451 available from Brooktree, Incorporated.

A hardware cursor circuit 120 provides either a full screen cross hair and/or a 64 bit by 64 bit user programmable cursor. The hardware cursor circuit 120 receives as an input from the digit signal processor 102 X and Y coordinate position data which are stored in internal cursor X, Y registers within hardware cursor circuit 120. The output of the hardware cursor circuit 120 is fed to an overlay input on color palette 118.

Hardware cursor circuit 120 may be implemented by a commercially available integrated circuit BT431 available from Brooktree Incorporated.

OPERATION

The host system processor in host system 10 may control the image o display monitor 20 in either one of two ways.

First, commands including graphics instructions and data may be passed to digital signal processor 102 causing DSP 102 to update the display. System processor can either place these commands in a shared memory area for execution by DSP 102 or the commands can be loaded into FIFO 110 for sequential execution.

Secondly, the system processor can control the information displayed on display monitor 20 by disabling digital signal processor 102 and accessing bit map 116 directly through pixel processor 114.

The operation of a preferred embodiment of the present invention will focus on the first manner of handling graphics data described above. That is, the transmission of graphics instructions and data to the digital signal processor 102 from the host 10.

The graphics display adapter in accordance with the preferred embodiment of the present invention, uses a digital signal processor 102 as a primary interface to the host processor 10. In a preferred embodiment of the present invention, digital signal processor 102 may be implemented by a TMS 32020 integrated circuit which has the capability to execute five million instructions per second. The digital signal processor 102 can handle interrupts from the host 10 or the pixel processor 114 which generates interrupts on any of the following conditions:

(1) Task complete;

(2) Pick window entered; or (3) Vertical retrace started.

The digital signal processor 102 also contains a timer which can be used, for example, to control the time between display updates.

In the preferred embodiment of the present invention, display adapter 100, provides 128K of RAM for DSP 102 to use as instruction space. Instruction memory 106 which is part of system memory 104 is operated in page mode so that a accesses to words located on the same page (that is the higher 8 address bits are the same) require no wait states in DSP 102. Accesses to words on a new page cause one wait state. Thus, locating frequently executed program code loops on a single page, will provide maximum execution speed. The instruction memory 106 is dual ported, that is host 10 and DSP 102 have concurrent access to it.

In addition to instruction storage 106, system memory 104 also includes data storage 108 which in a typical environment may provide 256K bytes of random access memory for DSP 102 to use as a data storage. The data storage is also operated in page mode as is the instruction storage 106 so that access to words located on the same page require 0 DSP 102 wait states.

Although DSP 102 in the preferred embodiment may have a data addressing capability limited to 64K words, a bank switch mechanism may be provided to extend the address space. The bank space allows full access to data memory in excess of 64K words. In the embodiment described herein, four banks of 64K bytes each have been implemented to achieve a total data storage of 256K bytes. However, address logic and architecture allow expansion to an even greater number of banks so that a larger data memory may be employed.

As with the instruction storage, data storage 108 is dual ported so that the host and DSP 102 have concurrent access to it. This easy access allows the data storage 108 to act as a main avenue of communication between host 10 and DSP 102.

The input FIFO buffer may be used to accept and temporarily store instructions and data from host 10 which may be sequentially accessed by DSP 102 as the information is needed. FIFO buffer 110 includes three flags. These are the empty flag, the half-full flag and the full-flag which can be read by host 10 to determine if there is room in FIFO 110 to write more information. In addition to the three flags, FIFO 110 also has three interrupts associated with it. A half-full interrupt, a half-empty interrupt and a FIFO over-flow interrupt are provided. The first two may be used to pace writes to FIFO 110 without polling the flags while the last interrupt would normally be considered an error condition. DSP 102 can also read the flags in FIFO 110 to determine if more information should be read from FIFO 110.

PIXEL PROCESSOR 114

Although pel processor 114 is described in greater detail in co-pending U.S. patent application No. 07/013,840, the operation will be briefly described herein. When drawing lines, pixel processor 114 can either be given end points of the line with Bresenham's parameters calculated by the pel processor to generate pixels along the line, or end points of a line along with the parameters required by Bresenham's incremental line drawing algorithm. The later case allows more control of vector to raster translation and may be useful for special cases such as wide lines. In addition, line attributes of color and type are supported directly by pixel processor 114. Lines may be drawn in replace mode, with logical operations, or line on line mode.

Bit block transfer may also be performed by pixel processor 114. Some bit block transfers operate with minimal processor intervention. Others require more intervention from the processor. Bit block transfer can proceed with the innerloop either horizontally or vertically oriented. Vertical orientation is particularly useful when transferring images of character strings to bit map frame buffer 116. In addition, pixel processor 114 has the ability to perform bit block transfers with color expansion. Color expansion is defined as a processes of taking data in which each active bit represents a pixel of a known color and a zero indicates transparency (that is the frame buffer is not altered for that pixel location). This mode offers a performance advantage as each word of data represents 16 pixels of screen memory rather than 2. When using color expansion, the block being transferred may be rotated in any one of four possible 90 degree orientations.

During both line draw and bit block transfer operations, pixel processor 114 can scissor the object being drawn to a predetermined scissoring window. That scissoring window may be a rectangle defined to the pixel processor and then as long as scissoring is enabled only the portion of the line or bit block transfer within the rectangle will be written to the frame buffer 116. Any part of the line or bit block transfer that would appear outside the scissoring window is discarded. Also, pixel processor 114 provides for a pick window. The pick window can be defined to the pixel processor and when enabled any access to the bit map frame buffer 116 within the window causes an interrupt to digital signal processor 102 which can be used for drawing objects to identify objects being drawn where any part of the object falls within the specified window.

BIT MAPPED FRAME BUFFER 116

Bit mapped frame buffer 116 consists of one megabyte of video random access memory. The bit map is displayed on the screen as a 1K×1K pixel image having 8 bytes per pixel. Pixel processor 114 acts as the interface between digital signal processor 102 and bit mapped frame buffer 116. Depending upon how some of the bits located within pixel processor 114 are set, bit mapped frame buffer 116 will be read as either two horizontally adjacent pixels or four horizontally adjacent half-pixels, half-pixel being defined as either the high nibble or low nibble of the pixel. It can be written in the same way or a four by four square of pixels can be written. In all addressing modes, the bit map is pixel addressable. That is, X and Y address registers in the pixel processor 114 are use to indicate the pixel being addressed. Depending on the addressing being used (two pixel, four half-pixel, or four by four write), the addressed pixel will lie on either end of or at any corner of the area of the bit map accessed. This determination is made by the octant register.

The organization and structure of the bit mapped frame buffer 116 is described in much greater detail in the co-pending U.S. patent application identified above (Ser. No. 07/013,843. Pixel data from bit mapped frame buffer 116 is transmitted to color palette 118 as 8 bit representations. Color palette 118 transforms the 8 bit representation for each pixel to be drawn on display monitor 20 into appropriate color and other attribute signals which are then transmitted to monitor 20 on signal lines 22.

Although the invention has been described to a preferred embodiment thereof, it should be understood that various changes may be made by persons skilled in the art without departing from the spirit or scope of the invention as defined in the following claims.

We claim:

1. A system for displaying graphics data in pixel form on a high resolution display monitor, comprising, in combination;

a host processor for providing instructions and data representing information to be displayed;

a graphics adapter, connected to said host processor, comprising:

a system storage connected to said host processor for storing instructions and data representing information to be displayed;

a first processor connected to said system storage for managing a plurality of graphics adapter resources and for performing transformation on coordinate data stored in said system storage;

a first-in, first-out input buffer connected to said first processor for providing a synchronous and overlapped communication between said graphics adapter and said host processor;

a second processor connected to an output of said first processor and to said system storage for drawing vectors and manipulating areas to be displayed on said monitor;

a frame buffer connected to outputs of said second processor for storing bit map of data to be displayed, said first and second processors being used to update said frame buffer data;

a color palette connected to outputs of said frame buffer providing selected color signals to said display monitor; and a cursor generating circuit connected to said color palette and to said first processor for controlling the display of a cursor on said display monitor.

2. A system for displaying graphics data in pixel form on a high resolution graphics display monitor according to claim 1, wherein said first processor comprises a digital signal processor having a capability of handling interrupts from either said host processor or said second processor.

3. A system for displaying graphics data in pixel form on a high resolution graphics display monitor in accordance with claim 1, wherein said system storage further comprises;

a first portion for storing instructions for said first processor; and a second portion for storing data to be displayed.

4. A system for displaying graphics data in pixel form on a high resolution graphics display monitor according to claim 3 wherein said first portion of said system storage is organized such that frequently executed program code loops are stored on a common memory page for enhancing system execution speed.

5. A system for displaying graphics data in pixel form on a high resolution graphics display monitor in accordance with claim 3 wherein said second portion of said system storage comprises dual ports for allowing simultaneous access by said host and said first processors.

6. A system for displaying graphics data in pixel form on a high resolution graphics display monitor according to claim 1 wherein said first-in, first-out input buffer is adapted to store a plurality of flag bits which may be interrogated by said host processor to determine availability of said display system for further data transfer.

* * * * *